US009384696B2

(12) United States Patent
Okuno et al.

(10) Patent No.: US 9,384,696 B2
(45) Date of Patent: Jul. 5, 2016

(54) DISPLAY DEVICE, METHOD OF CALCULATING COMPENSATION DATA THEREOF, AND DRIVING METHOD THEREOF

(71) Applicant: SAMSUNG DISPLAY CO., LTD., Yongin, Gyeonggi-Do (KR)

(72) Inventors: Takeshi Okuno, Yokohama (JP); Kazunori Morimoto, Yokohama (JP); Naoaki Komiya, Yokohama (JP)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 39 days.

(21) Appl. No.: 14/553,106

(22) Filed: Nov. 25, 2014

(65) Prior Publication Data

US 2015/0154910 A1 Jun. 4, 2015

(30) Foreign Application Priority Data

Nov. 29, 2013 (JP) ..... 2013-248470
Nov. 29, 2013 (JP) ..... 2013-248715

(51) Int. Cl.
*G09G 3/32* (2006.01)

(52) U.S. Cl.
CPC ..... *G09G 3/3283* (2013.01); *G09G 3/3258* (2013.01); *G09G 2300/0819* (2013.01); *G09G 2320/0233* (2013.01); *G09G 2320/0257* (2013.01); *G09G 2320/0285* (2013.01); *G09G 2320/0295* (2013.01); *G09G 2320/041* (2013.01); *G09G 2320/045* (2013.01)

(58) Field of Classification Search
CPC ... G09G 3/006; G09G 3/3258; G09G 3/3283; G09G 2300/0819; G09G 2320/0233; G09G 2320/0257; G09G 2320/0285; G09G 2320/0295; G09G 2320/041; G09G 2320/043; G09G 2320/045
See application file for complete search history.

(56) References Cited

U.S. PATENT DOCUMENTS

2005/0110720 A1* 5/2005 Akimoto ..... G09G 3/3233 345/76
2006/0033452 A1* 2/2006 Yamazaki ..... G09G 3/3258 315/291
2008/0042943 A1 2/2008 Cok

FOREIGN PATENT DOCUMENTS

EP 2126883 B1 12/2009
JP 2005-275182 10/2005
JP 2007-187761 7/2007
JP 2008-185670 8/2008
JP 2009-098433 5/2009
JP 2010-500620 A 1/2010
JP 2010-091703 4/2010

* cited by examiner

*Primary Examiner* — Larry Sternbane
(74) *Attorney, Agent, or Firm* — Lee & Morse, P.C.

(57) ABSTRACT

A display device includes a sensing driver, a memory, a first compensator, and a second compensator. The sensing driver measures a first voltage value applied to a light emitter in a pixels. The memory stores a second voltage value previously measured for the pixel. The first compensator calculates a temperature of the light emitter at a time of measuring the first voltage value, and compensates for the first voltage value based on the temperature. The second compensator compensates for input data for the pixel based on a voltage variation obtained from the temperature-compensated first voltage value and the second voltage value.

20 Claims, 16 Drawing Sheets

DISPLAY DEVICE, METHOD OF CALCULATING COMPENSATION DATA THEREOF, AND DRIVING METHOD THEREOF

CROSS-REFERENCE TO RELATED APPLICATION

Japanese Patent Applications Nos. 2013-248470 and 2013-248715, filed on Nov. 29, 2013, and entitled, "Display Device, Method of Calculating Compensation Data Thereof, and Driving Method Thereof," is incorporated by reference herein in its entirety.

BACKGROUND

1. Field

One or more embodiments described herein relate to a display device a method for calculating compensation data of a display device, and a method for driving a display device.

2. Description of the Related Art

A variety of displays have been developed. Examples include a liquid crystal display and an organic electroluminescent (EL) display. An organic EL display is thin and operates at low power levels.

In operation, each of the light emitting devices of the display experiences stress. The amount of degradation of the light emitting devices may differ based on differences in the amount of stress accumulated for each pixel. The amount of stress is proportional to the product of luminance (e.g., amount of current flowing into the light emitting device) and time. The luminance and amount of stress accumulated for each pixel may also differ for different display patterns.

Based on these and other influences, the amount of degradation experienced by each pixel may be non-uniform. Also, after a predetermined time passes, an image sticking phenomenon may occur, even though the same data voltage is applied to each pixel. As a result, the quality or reliability of the display may be degraded.

SUMMARY

In accordance with one embodiment, a display device includes a pixel, a sensing driver to measure a first voltage value applied to a light emitter in the pixel, a memory to store a second voltage value previously measured for the pixel, a first compensator to calculate a temperature of the light emitter at a time of measuring the first voltage value, and to compensate for the first voltage value based on the temperature, and a second compensator to compensate for input data for the pixel based on a voltage variation obtained from the temperature-compensated first voltage value and the second voltage value.

The first compensator may calculate the temperature based on one of the following equations, $$\text{Temp}=(\text{Voled}/C1)^{1/b1},$$

or $$\text{Temp}=\exp^{((Voled-b1)/C1)}$$

where Temp is the temperature, Voled is the first voltage value and C1 and b1 are predetermined integers, and may compensate for the first voltage value based on the following equation:

$$\Delta V_T=C2\cdot\ln(\text{Temp})+b2$$

where $\Delta V_T$ is a temperature compensation value, Temp is temperature, and C2 and b2 are predetermined integers. The second voltage value may be a value temperature-compensated by the first compensator.

The device may include operation logic to calculate the voltage variation from the first and second voltage values, to calculate an amount of luminance degradation from the voltage variation based on a first function, and to calculate a compensation current and compensation voltage data from the luminance degradation amount based on a second function, wherein the second compensator is to compensate for the input data based on the compensation voltage data.

The first function may include the following equation:

$$\Delta L=C5\cdot\Delta V^{b5}+A5$$

where ΔL is the luminance degradation amount, ΔV is the voltage variation, and C5, b5, and A5 are predetermined integers.

The second function may include the following equation:

$$\Delta I=(Ia/\Delta L)-Ia$$

where ΔI is the compensation current, ΔL is the luminance degradation amount, and Ia is a check current for measuring the voltage.

The first compensator may calculate the temperature based on the following equation:

$$\text{Temp}=C3\cdot\Sigma\text{data}(t)$$

where Temp is the temperature, t is a predetermined period, and where C3 is a predetermined integer, and may compensate for the first voltage value based on the following equation:

$$\Delta V_T=C4\cdot\ln(\text{Temp})+b4$$

where $\Delta V_T$ is the temperature compensation value to compensate for the first voltage value, Temp is the temperature, and where C4 and b4 are predetermined integers.

In accordance with another embodiment, a method of calculating compensation data of a display device includes measuring a first voltage value applied to a light emitter in a pixel, calculating a temperature of the light emitter at a time of measuring the first voltage value, compensating for the first voltage value based on the temperature, calculating a voltage variation based on the temperature-compensated first voltage value and a second voltage value previously measured and stored in a memory for each of the pixels, and compensating for input data for the pixel based on the voltage variation.

Calculating the temperature may be performed based on one of the following equations:

$$\text{Temp}=(\text{Voled}/C1)^{1/b1},$$

or $$\text{Temp}=\exp^{((Voled-b1)/C1)}$$

where Temp is the temperature, Voled is the first voltage value, and C1 and b1 are predetermined integers, and compensating for the first voltage value may be performed based on the following equation:

$$\Delta V_T=C2\cdot\ln(\text{Temp})+b2$$

where Temp is the temperature, $\Delta V_T$ is a temperature compensation value, and C2 and b2 are predetermined integers. The second voltage value may be a value compensated based on the light emitter at a time of measuring the second voltage value.

Compensating for the input data may include calculating an amount of luminance degradation from the voltage variation based on the first function, calculating a compensation current from the luminance degradation amount based on the second function, adjusting compensation voltage data based on the compensation current, and compensating for the input data based on the compensation voltage data.

The first function may include the following equation:

$$\Delta L = C5 \cdot \Delta V^{b5} + A5$$

where ΔL is the luminance degradation amount, ΔV is the voltage variation, and C5, b5, and A5 are predetermined integers.

The second function may include the following equation:

$$\Delta I = (Ia/\Delta L) - Ia$$

where ΔI is the compensation current, ΔL is the luminance degradation amount, and Ia is a check current for measuring the voltage.

Calculating the temperature may be performed based on the following equation:

$$\text{Temp} = C3 \cdot \Sigma \text{data}(t)$$

where Temp is the temperature, t is a predetermined period, and C3 is a predetermined integer, and compensating for the first voltage value may be performed based on the following equation:

$$\Delta V_T = C4 \cdot \ln(\text{Temp}) + b4$$

where Temp is the temperature, $\Delta V_T$ is the temperature compensation value to compensate for the first voltage value, and C4 and b4 are predetermined integers.

In accordance with one embodiment, a driving method of a display device includes measuring a first voltage value applied to a light emitter in a pixel, calculating a temperature of the light emitter at a time of measuring the first voltage value, compensating for the first voltage value based on the temperature, calculating a voltage variation based on the temperature-compensated first voltage value and a second voltage value previously measured and stored in a memory, and compensating for input data for the pixel based on the voltage variation.

Calculating the temperature may be performed based on one of the following equations:

$$\text{Temp} = (\text{Voled}/C1)^{1/bl},$$

or $$\text{Temp} = \exp^{(Voled-b1)/C1)}$$

where Temp is the temperature, Voled is the first voltage value, and C1 and b1 are predetermined integers, and compensating for the first voltage value may be performed based on the following equation:

$$\Delta V_T = C2 \cdot \ln(\text{Temp}) + b2$$

where Temp is the temperature, $\Delta V_T$ is a temperature compensation value, and C2 and b2 are predetermined integers. The second voltage value may be a value compensated based on the temperature of the light emitter at a time of measuring the second voltage value.

Compensating for the input data may includes calculating an amount of luminance degradation from the voltage variation based on the first function, calculating a compensation current from the luminance degradation amount based on, adjusting compensation voltage data to the compensation current, and compensating for the input data based on the compensation voltage data.

The first function may include the following equation:

$$\Delta L = C5 \cdot \Delta V^{b5} + A5$$

where ΔL is the luminance degradation amount, ΔV is the voltage variation, and C5, b5, and A5 are predetermined integers, and the second function may include the following equation:

$$\Delta I = (Ia/\Delta L) - Ia$$

where ΔI is the compensation current, ΔL is the luminance degradation amount, and Ia is a check current for measuring the voltage.

Calculating the temperature may be performed based on the following equation:

$$\text{Temp} = C3 \cdot \Sigma \text{data}(t)$$

where Temp is the temperature, t is a predetermined period t, and C3 is predetermined integer, and compensating for the first voltage value may be performed based on the following equation:

$$\Delta V_T = C4 \cdot \ln(\text{Temp}) + b4$$

where Temp is the temperature, $\Delta V_T$ is the temperature compensation value $\Delta V_T$ to compensate for the first voltage value, and C4 and b4 are predetermined integers.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
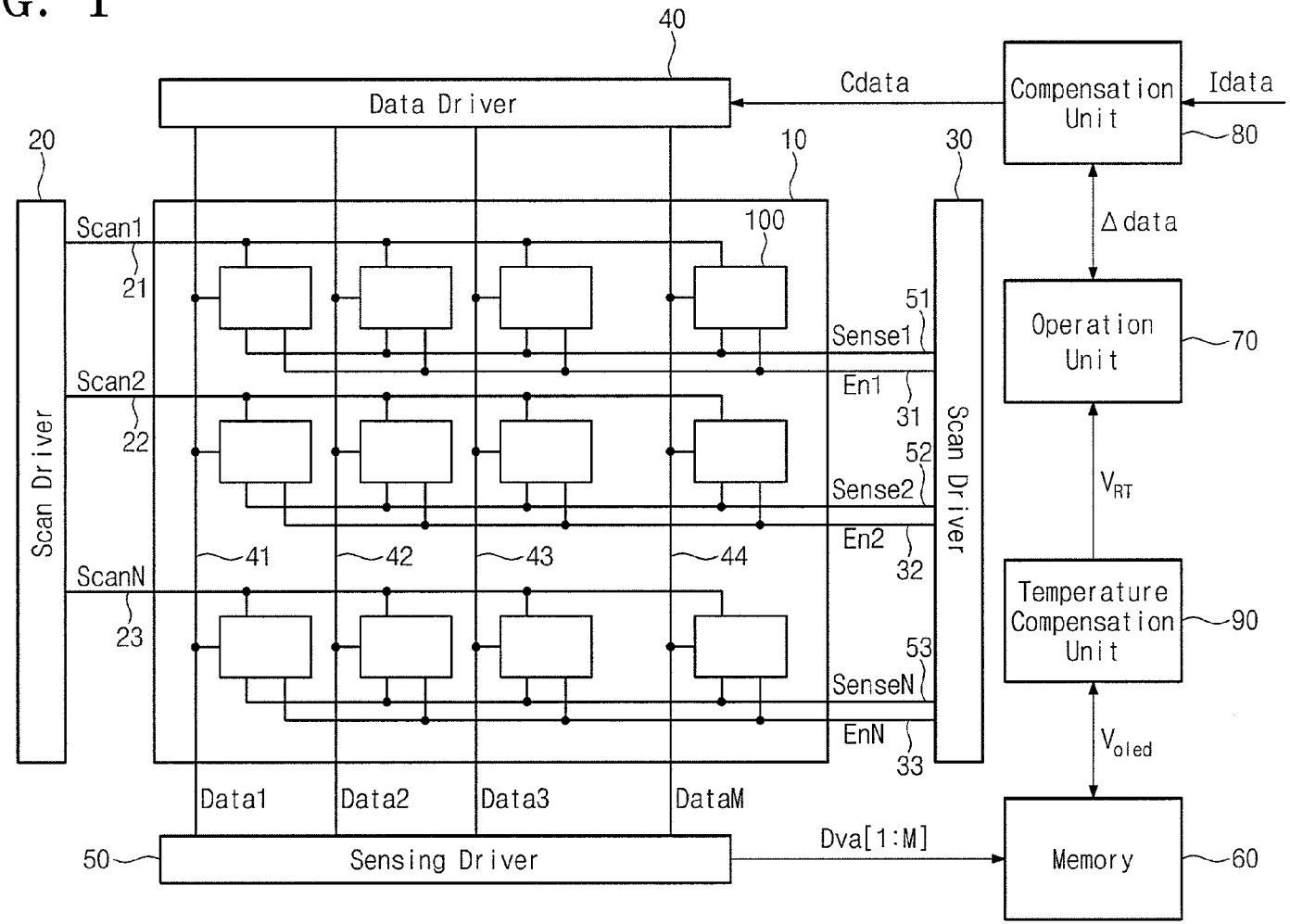
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of a display device which includes a display unit 10, a scan driver 20, a scan driver 30, a data driver 40, a sensing driver 50, a memory 60, an operation unit 70, a compensation unit 80, and a temperature compensation unit 90.

The display unit 10 includes a plurality of pixels 100. The pixels 100 are arrayed in a matrix shape of N rows and M columns, where N and M are natural numbers. The scan drivers 20 and 30 control each of the plurality of pixels 100.

The data driver 40 outputs data for determining pixel gradation. The sensing driver 50 measures voltages (e.g., anode voltages) applied to a light emitting device disposed in each of the pixels 100 and outputs the measured data Dva[1:M]. The measured data Dva[1:M] measured by the sensing driver 50 is stored in the memory 60.

The temperature compensation unit 90 calculates a temperature of the light emitting device at the time of past and current measurements of the anode voltage, by using the data measured in the past and current time and stored in the memory 60. In addition, the temperature compensation unit 90 temperature-compensates for the past and current anode voltages Voled on the basis of the calculated temperature. Past and current reference anode voltages $V_{RT}$ temperature-compensated by the temperature compensation unit 90 are provided to the operation unit 70.

The operation unit 70 outputs compensation voltage data Δdata on the basis of voltage variations, which, for example, may be obtained from past and current reference anode voltages $V_{RT}$. The operation unit may be operation logic which, for example, may include hardware circuits, software, or a combination of both.

The compensation unit 80 compensates for input data Idata received externally on the basis of the compensation voltage data Δdata, and outputs compensated image data Cdata.

In one embodiment, anode voltages Voled before temperature-compensation are stored in the memory 60. The temperature-compensated reference anode voltage $V_{RT}$ may also be stored in the memory 60, or in another memory or storage device.

The scan driver 20 applies gate control signals Scan1 to ScanN to control signal lines 21 to 23 corresponding to each row of pixels 100. The scan driver 30 applies emission control signals En1 to EnN to emission control lines 31 to 33, and provides sensing control signals Sense1 to SenseN to sensing control lines 51 to 53.

The pixels 100 receiving the gate control signals Scan1 to ScanN and emission control signals En1 to EnN receive data voltages Data1 to DataM output from the data driver 40 through data lines 41 to 44.

An anode voltage of a light emitting device of each of the pixels 100, which receive the sensing control signals Sense1 to SenseN, is measured by the sensing driver 50 through the data lines 41 to 44. The measured anode voltage are output as the measured data Dva[1:M], and are stored in the memory 60.

The light emitting device of each of the pixels 100 includes a light emitting diode. In one embodiment, the light emitting diode may be an organic light emitting diode (OLED). In another embodiment, a different type of light-emitting device may be used.

Figure 2:
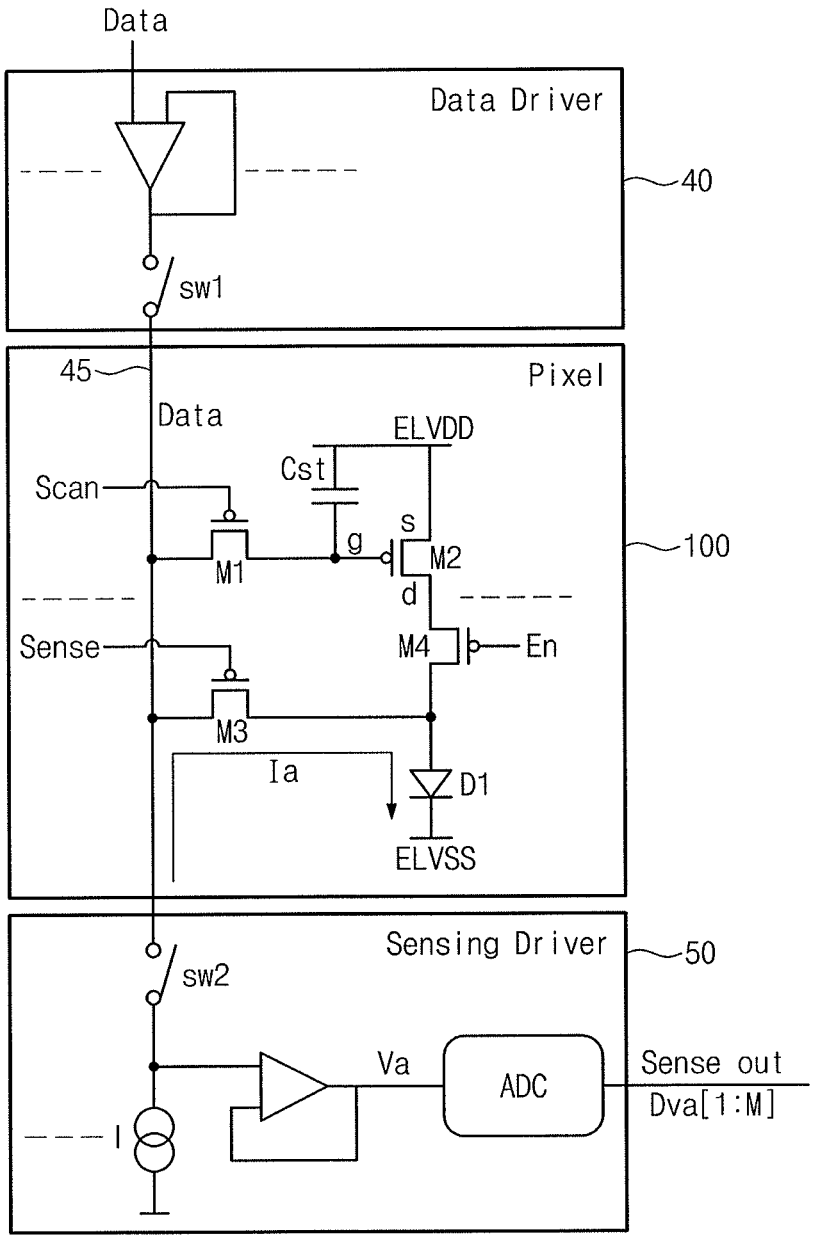
FIG. 2 illustrates embodiments of a pixel, a data driver, and a sensing driver.

FIG. 2 illustrates embodiments of the pixel 100, the data driver 40, and the sensing driver 50 in FIG. 1. Referring to FIG. 2, the pixel 100 includes the light emitting device, a driving transistor M2, switch transistors M1, M3, and M4, and a capacitive device Cst. The transistors M1 to M4 of the pixel circuit 100 may be, for example, p-channel transistors. Accordingly, each of the transistors M1 to M4 is turned on when a low-level signal is applied to a gate terminal of each of transistors M1 to M4.

The driving transistor M2 drives the light emitting device D1. The switch transistor M1 is controlled by a gate control signal Scan, and provides a data voltage Data for determining pixel gradation to a gate electrode g of the driving transistor M2.

The switch transistor M4 is controlled by an emission control signal En, and controls light emission or non-emission of the light emitting device D1. The switch transistor M3 is controlled by a sensing control signal Sense, and provides a check current Ia for measuring the anode voltage of the light emitting device D1 to the light emitting device D1. The capacitive element Cst is charged with or based on an input data voltage Data.

The data driver 40 converts input digital image data to an analog voltage signal. The data driver 40 outputs the analog voltage signal to the data line 45 of the pixel 100 as the data voltage Data through a switch SW.

The sensing driver 50 provides check current Ia to the light emitting device D1 of the pixel 100, and measures to output the anode voltage Va of the light emitting device V1. For example, a current source I of the sensing driver 50 provides check current Ia to the light emitting device D1 of the pixel 100 through the control switch SW2 and the switch transistor M3. The sensing driver measures the anode voltage Va of the light emitting device D1.

An analog-to-digital converter (ADC) of the sensing driver 50 converts the measured anode voltage Va into digital data. The measured data Dva[1:M] of the digitalized anode voltage is output through an output terminal Sense out.

The control switches SW1 and SW2 may be, for example, n-channel transistors which turn on in response to a high-level signal is applied to their gate terminals. In another embodiment, the control switches SW1 and SW2 may be p-channel transistors which turn on in response to a low-level signal.

Figure 3:
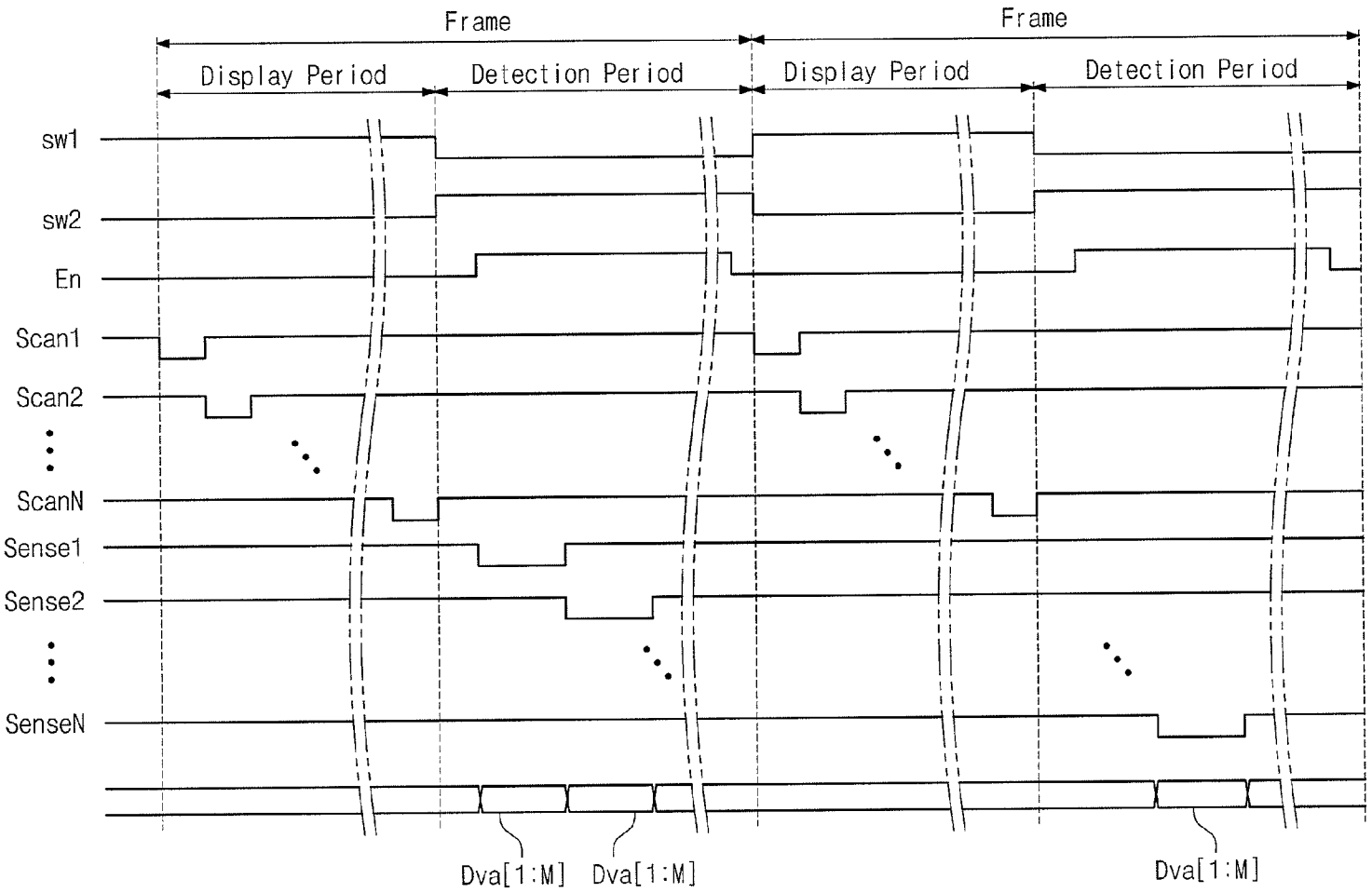
FIG. 3 illustrates an embodiment of a method for driving a display device.

FIG. 3 is a timing diagram illustrating an embodiment of a method for driving a display device. Referring to FIG. 3, each frame includes a display period and a detection period which are temporarily divided. In the display period in each frame, display data is updated. During the display period, the control switch SW1 of the data driver 40 is turned on and the control switch SW2 of the sensing driver is turned off.

For the gate control signal Scan, gate control signals Scan1 to ScanN are sequentially scanned on the pixels 100 in row units. Accordingly, the low-level signal is sequentially provided in a row unit to the switch transistors M1. As a result, the switch transistors M1 are sequentially turned on in a row unit. A data voltage Data for determining gradation of the pixel 100 is provided to the driving transistor M2 of each of the pixels 100.

Because the emission control signal En has a low level, the switch transistor M4 is in an On state. Accordingly, a driving current Ioled based on the data voltage Data is provided to the light emitting device D1 through the driving transistor M2 and the switch transistor M4, and the light emitting device D1 emits light.

In the detection period, the control switch SW1 of the data driver 40 is turned off and the control switch SW2 of the sensing driver is turned on. For the sensing control signal Sense, the sensing control signals Sense1 to SenseN are sequentially scanned on the pixels 100 in a row unit. Because a low-level signal is sequentially provided to the switch transistors M3 in a row unit, the switch transistors M3 are sequentially turned on in a row unit. As a result, the check current Ia having a predetermined current value is provided from the current source to the light emitting device D1 through the control switch SW2 and the switch transistor M3 of each of the pixels 100. The anode voltage Va may be measured based on the check current Ia.

In FIG. 3, the sensing control signals Sense are illustrated as being scanned on the pixels 100 for two detection periods. Degradation of the pixel 100 may not proceed in one frame unit, but may proceed in a period, for example, of dozens of frames or tens of thousands of frames.

Accordingly, it may not be necessary to complete measurement of anode voltages for all the pixels in one frame. It may be sufficient to measure anode voltages of all pixels in a unit of dozens of frames or tens of thousands of frames.

The longer the measurement time of anode voltages of the pixels 100 is, the greater the measurement precision of the anode voltages. Accordingly, the number of pixels 100 measured in one frame period may be set to be relatively small (e.g., a predetermined value below a threshold value) and the measurement time of the anode voltage for one pixel may be set to be long (e.g., a predetermined value greater than a threshold value).

In addition, the anode voltages of the pixels 100 may not have to be periodically measured. For example, the anode voltage measurements of the pixels 100 may be irregularly performed in time (e.g., non-uniform predetermined times) when the display device is turned ON or OFF.

The measured anode voltage Va is provided to the sensing driver 50. The measured anode voltage Va is converted to digital data by the ADC of the sensing driver 50. The measured data Dva[1:M] of the digitalized anode voltage is output through an output terminal Sense out.

Substantially, the sensing driver circuit illustrated in FIG. 2 in the sensing driver 50 may be repeated, for example, based on the number of data lines. For example, for a display device that includes M data lines, M basic circuits of the sensing driver may be in the sensing driver 50.

Accordingly, by a scan of the sensing control signals Sense for one row, the M anode voltages of the pixels 100 may be measured and output. At this point, since the emission control signal En has a high level, the switch transistor M4 is in an Off state. Accordingly, image data charged in the capacitive device Cst of the pixel 100 does not affect the anode voltage measurement.

The measured data Dva[1:M] output from the sensing driver 50 is stored in the memory 60. After a predetermined period passes, the anode voltage is measured and the measured data Dvb[1:M] is stored in the memory 60.

The temperature compensation unit 90 calculates a temperature of the light emitting device D1 at the time of past and present anode voltage measurements, based on the anode voltage Va of each of the pixels 100 among the past measured data Dva[1:M] and the anode voltage Vb of each of the pixels 100 among the current measured data Dva[1:M] after the predetermined time passes.

The temperature compensation unit 90 calculates a temperature compensation value based on the calculated temperature and outputs a reference anode voltage $V_{RT}$ temperature-compensated with the temperature compensation value.

The operation unit 70 compares a current reference anode voltage $V_{RT}1$ and a past reference anode voltage $V_{RT}0$, and calculates a luminance degradation amount ΔL based on a voltage variation ΔV obtained from the current and past anode voltages $V_{RT}1$ and $V_{RT}0$. The operation unit 70 calculates a compensation current ΔI and compensation voltage data Δdata based on the luminance degradation amount ΔL.

The compensation unit 80 compensates for input data Idata to allow the pixels 100 to emit light based on the calculated compensation voltage data Δdata. The compensated input data Idata is output as compensated image data Cdata.

As previously indicated, a change amount of the temperature-compensated reference anode voltage is calculated for each of the pixels 100 of a display device, the input data Idata is compensated based on the calculated voltage variation ΔV, and then a compensation operation is performed according to a degradation amount of a light emitting device in each of the pixels 100. Accordingly, a display device according to one embodiment may reduce an image sticking phenomenon and improve display quality and reliability.

Figure 4:
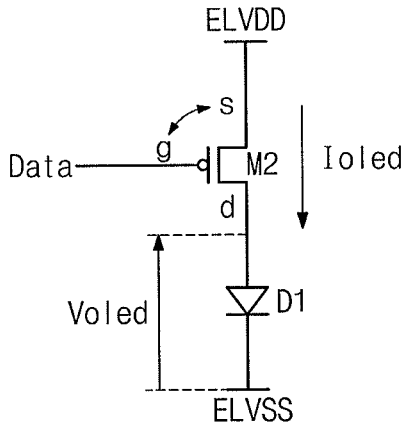
FIG. 4 illustrates an embodiment of a pixel circuit.

FIG. 4 illustrates an embodiment of a pixel circuit of a display device, which, for example, may be any of the aforementioned embodiments of the display device. Referring to FIG. 4, the pixel circuit includes the driving transistor M2 and a light emitting device D1. The driving transistor M2 may be, for example, a p-channel type. In another embodiment, the the driving transistor M2 may have an n-channel type.

A data voltage Data for determining the gradation of a pixel is applied to a gate electrode g of the driving transistor M2. A power supply voltage ELVDD of the light emitting device D1 is applied to a source electrode s of the driving transistor M2. A drain electrode d of the driving transistor M2 is connected to an anode electrode of the light emitting device D1. A power supply voltage ELVSS of the light emitting device D1 is applied to a cathode electrode of the light emitting device D1.

Because the light emitting device D1 is a current driven device, luminance of the light emitting device D1 changes in proportion to a driving current Ioled flowing into the light emitting device D1. For example, in order to control luminance, the data voltage Data applied to the gate electrode g of the driving transistor M2 is controlled, and a bias voltage between the power supply voltage ELVDD corresponding to a gate-source voltage Vgs of the driving transistor M2 and the data voltage Data changes. At this point, the anode voltage Voled applied to the light emitting device D1 is determined by the data voltage Data.

Figure 5:
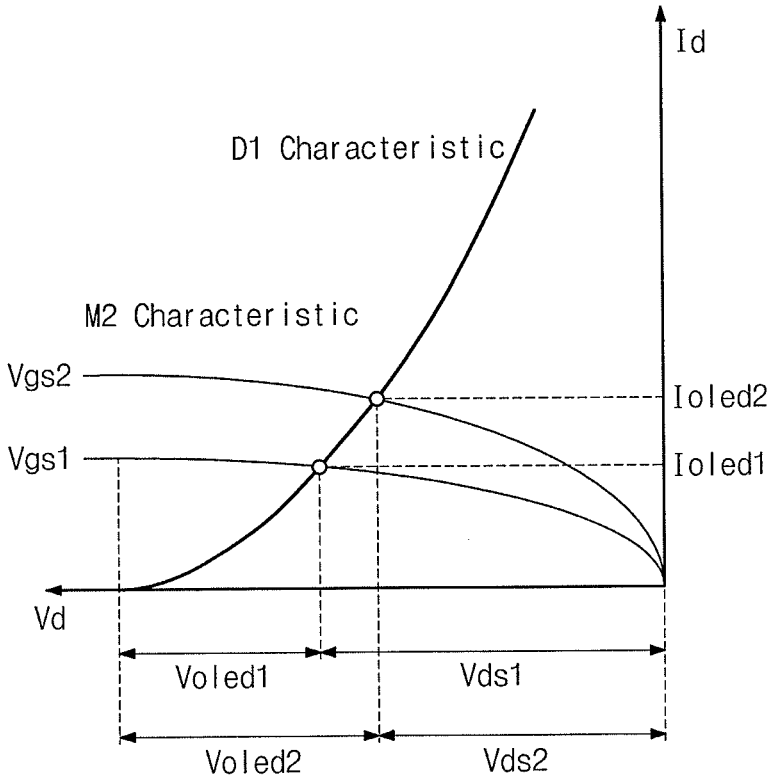
FIG. 5 illustrates an example of operation points of a pixel circuit.

FIG. 5 illustrates an example of operation points of a pixel circuit of a display device. In FIG. 5, first and second anode voltages Voled1 and Voled2 represent anode voltages applied to the light emitting device D1, when the driving transistor M2 is driven at first and second gate-source voltages Vgs1 and Vgs2. In addition, first and second driving currents Ioled1 and Ioled2 represent driving currents flowing into the light emitting device D1, when the driving transistor M2 is driven at the first and second gate-source voltages Vgs1 and Vgs2.

Referring to FIG. 5, the driving transistor M2 plays a role of a voltage-to-current converting device for driving the light emitting device D1 with a current. When the light emitting device D1 is driven for a predetermined time, characteristics of the light emitting device D1 are changed by degradation of the light emitting device D1 itself. Such a characteristic change of the light emitting device D1 is described below with reference to FIGS. 6 to 9.

Figure 6:
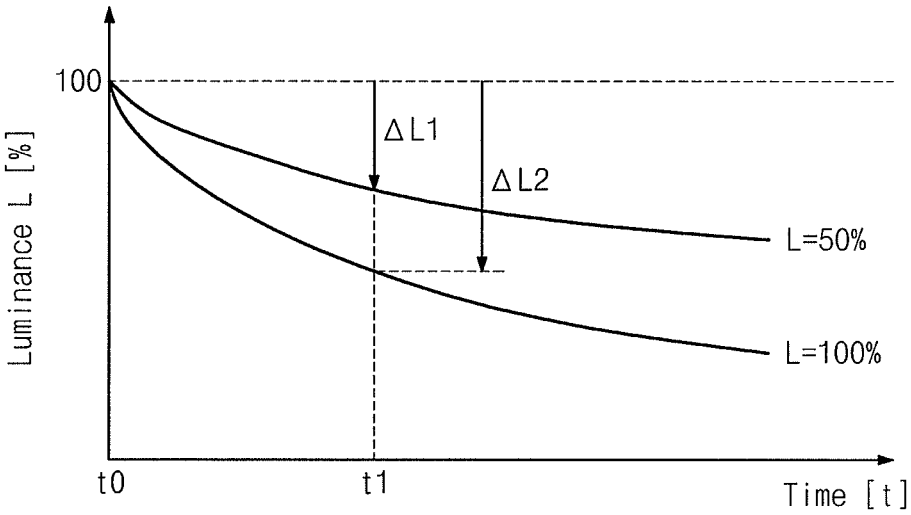
FIG. 6 illustrates an example of a relationship between time and luminance degradation in a display device.

FIG. 6 illustrates an example of relationship between passage of time and luminance degradation during operation of a display device. Specifically, FIG. 6 is a graphing that represents a state of luminance gradation according passage of time, when a predetermined current value is provided to the light emitting device D1 at an initial time t0 and initial luminance of the light emitting device D1 is defined as 100%.

In FIG. 6, in a case where the light emitting device D1 maintains a current value of the initial luminance and continuously emits a light, the luminance degradation according to passage of time is illustrated as L=100%. In a case where the light emitting device D1 maintains a current value corresponding to 50% of the current value of the initial luminance and continuously emits the light, the luminance degradation according to passage of time is illustrated as L=50%.

Referring to FIG. 6, luminance values that were 100% at the initial time t0 degrade, for the respective cases, by a second luminance variation ΔL2 and a first luminance variation ΔL1 at a first time t1 when a predetermined time passes from the initial time to. Put differently, the amount of luminance degradation experienced by the light emitting device D1 increases as the current value allowing the light emitting device D1 to emit light increases.

Figure 7:
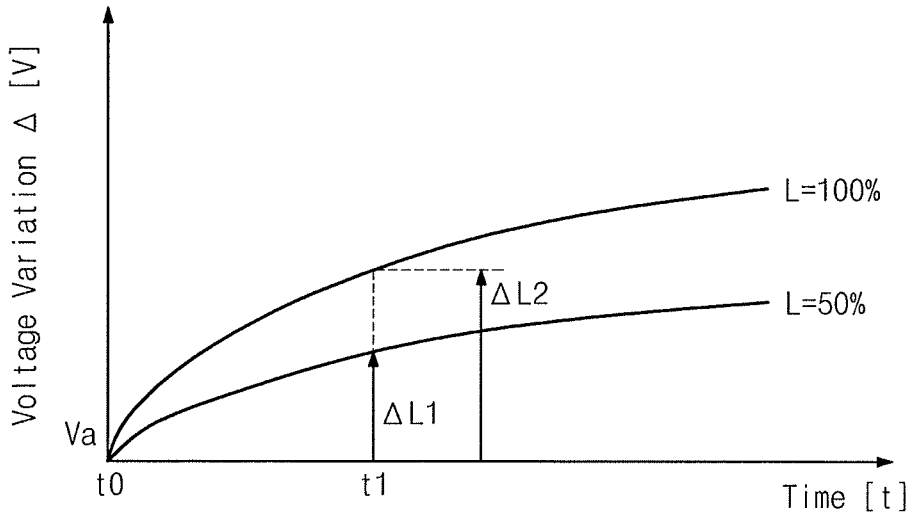
FIG. 7 illustrates an example of a relationship between time and an anode voltage in a display device.

FIG. 7 includes a graph illustrating a relationship between the passage of time and anode voltage according to one embodiment of a display device. The graph illustrates an anode voltage variation according to passage of time. In FIG. 7, the description of L=100% and L=50% is the same as in FIG. 6.

Referring to FIG. 7, the anode voltage Va at an initial time t0 increases according to passage of time by a second voltage variation ΔV2 and a first voltage variation ΔV1 at time t1. Thus, the anode voltage increases as the current value for allowing the light emitting device D1 to emit light increases.

Figure 8:
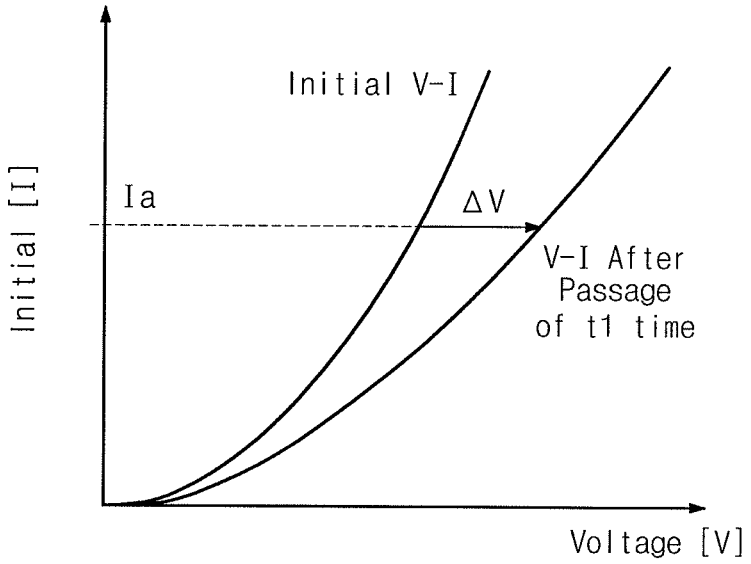
FIG. 8 illustrates a change in a voltage-current characteristic for one embodiment of a light emitting device.
Figure 9:
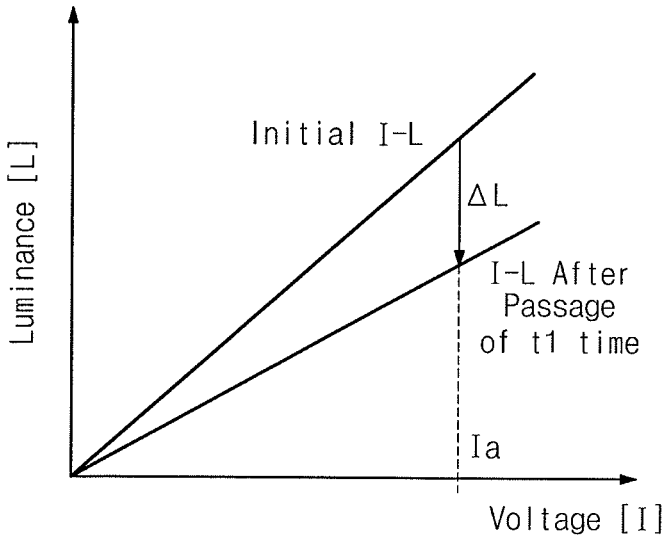
FIG. 9 illustrates a change in voltage-luminance characteristic for one embodiment of a light emitting device.

FIG. 8 illustrates an example of change in voltage-current characteristic of a light emitting device according to time variation. FIG. 9 illustrates an example of a change in voltage-luminance characteristic of a light emitting device according to time variation. More specifically, in FIGS. 8 and 9, graphs are provided which respectively illustrate changes in voltage-current characteristic (V-I) and current-luminance characteristic (I-L) of the light emitting device D1 at initial time t0 and first time t1.

Referring to FIGS. 8 and 9, the characteristics change according to degradation of the light emitting device D1. For example, in the voltage-current characteristic (V-I) in FIG. 8, the characteristic curve is entirely shifted to a high voltage side and the voltage-current characteristic (V-I) is shifted to the high voltage side by a voltage variation ΔV based on a predetermined current value Ia. In the current-luminance characteristic (I-L) in FIG. 9, luminance degradation occurs by a luminance variation ΔL based on the predetermined current value Ia.

When the light emitting device D1 is continuously driven with a predetermined static current, luminance of the light emitting device D1 degrades according to passage of time. In addition, the amount of luminance degradation increases as the current for driving the light emitting device D1 increases, and this is so even when the light emitting device D1 is driven for the same time period.

As a result, the amount of degradation of the light emitting device D1 differs for different amounts of stress accumulated on the pixels 100. For each pixel, the amount of accumulated stress may be proportional to a product of luminance of the pixel (determined, e.g., by an amount of current flowing into the light emitting device D1) and time.

Additionally, the amount of accumulated stress for each pixel 100 differs, and differences in the degradation amounts of each pixel 100 occur according to a displayed pattern. Accordingly, after a predetermined time passes, an image sticking phenomenon may occur in which pixel luminance differs according to the accumulated stress amount, even though the same data voltage is applied to each pixel 100.

As a result, the quality and reliability of the display device may adversely affected. Hereinafter, a relationship between anode voltage and temperature of the light emitting device, which affects measurement of the anode voltage, is described. Then, a method of compensating for a temperature effect will be described.

Two type of temperature effects may influence operation of the light emitting device. The first type of temperature effect is a temperature of the environment surrounding the display device. A temperature variation in the surrounding environment may change an entire temperature of the display device. The second type of temperature effect is local heat occurring in the display device at the time of driving the display device. For example, at the time of driving the display device, the pixels 100 are affected by local heat occurring in transistors of the pixel circuits.

A method of compensating for an anode voltage variation that occurs due to temperature variation caused by the local heat is described below.

Figure 10:
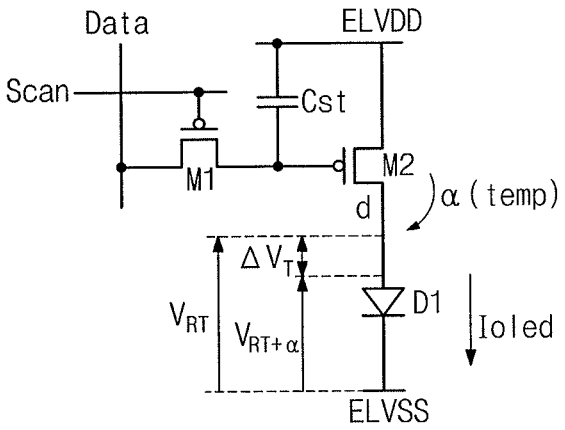
FIG. 10 illustrates a change in anode voltage based on pixel circuit configuration and temperature variation in one embodiment of a display device.

FIG. 10 conceptually illustrates a change in anode voltage based on a pixel circuit configuration and temperature variation in one embodiment of a display device. The pixel circuit configuration of FIG. 10 may be the same as in FIG. 1, except for the switch transistors M3 and M4.

Referring to FIG. 10, because the light emitting device D1 is a current-driven device, drain current flowing into the driving transistor M2 is the driving current Ioled flowing into the light emitting device D1. Because the current flows through the driving transistor M2, heat (α(temp)) occurs in the driving transistor M2 according to the current amount. Temperature of the light emitting device D1 adjacent to the driving transistor M2 increases by an effect of such heat (α).

Figure 11:
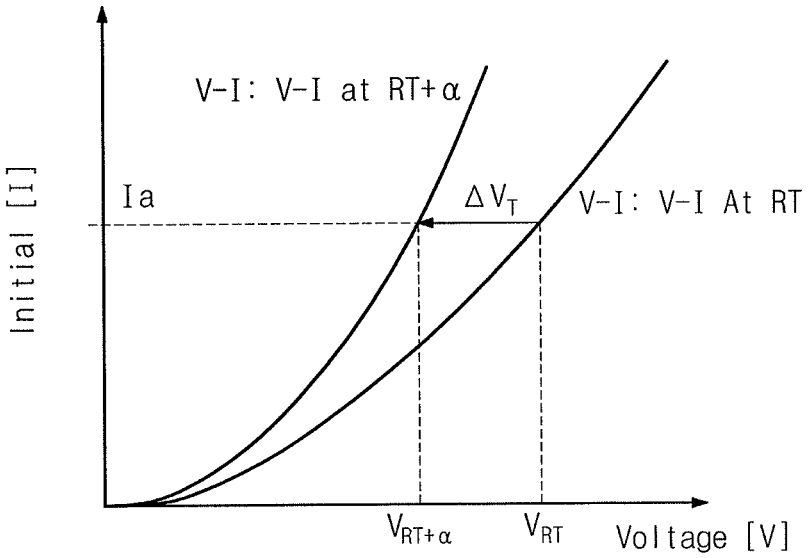
FIG. 11 illustrates a change in voltage-current characteristic for one embodiment of a light emitting device.

FIG. 11 illustrates a change in voltage-current characteristic of a light emitting device based on a temperature variation in accordance with one embodiment. Referring FIG. 11, the voltage-current characteristic (V-I) of the light emitting device in a room temperature (RT) shifts towards a low voltage direction as the temperature increases by heat (a). For example, when a current Ia flows into the driving transistor M2, a driving voltage shifts from the reference anode voltage $V_{RT}$ to the anode voltage $V_{RT+\alpha}$ by a voltage variation $\Delta V_T$.

Figure 12:
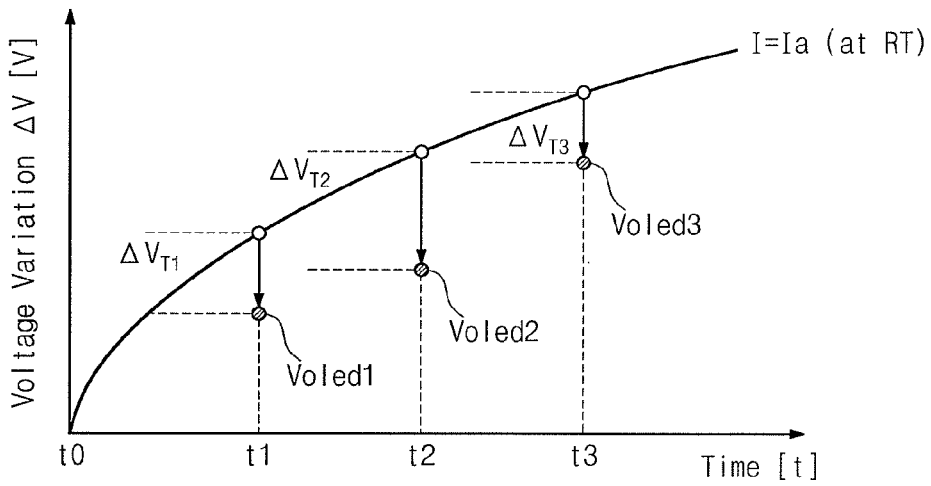
FIG. 12 illustrates a change in anode voltage for one embodiment of a light emitting device.

FIG. 12 illustrates a change in anode voltage of a light emitting device based on time and temperature in accordance with one embodiment. Referring to FIG. 12, when the driving current Ia is provided to the light emitting device D1, the anode voltages at first, second, and third times t1, t2, and t3 are affected by temperature variation of the light emitting device D1 and are respectively measured as first, second, and third anode voltages Voled1, Voled2, and Voled3.

The first, second, and third anode voltages Voled1, Voled2, and Voled3 are compared with the reference anode voltage $V_{RT}$ at room temperature RT and respectively shifted by first, second, and third voltage variations $\Delta V_{T1}$, $\Delta V_{T2}$, and $\Delta V_{T3}$.

In order to more precisely measure the amount of luminance degradation from the anode voltage variation, the measured anode voltage may be compensated with the reference anode voltage corresponding to the room temperature RT.

Furthermore, a change in current-luminance characteristic (I-L) of the light emitting device D1 according to a temperature variation may be much less than a change in voltage-current characteristic (V-I) according to temperature. Accordingly, the effect on the luminance of each pixel by the temperature variation may be substantially negligible.

Figure 13:
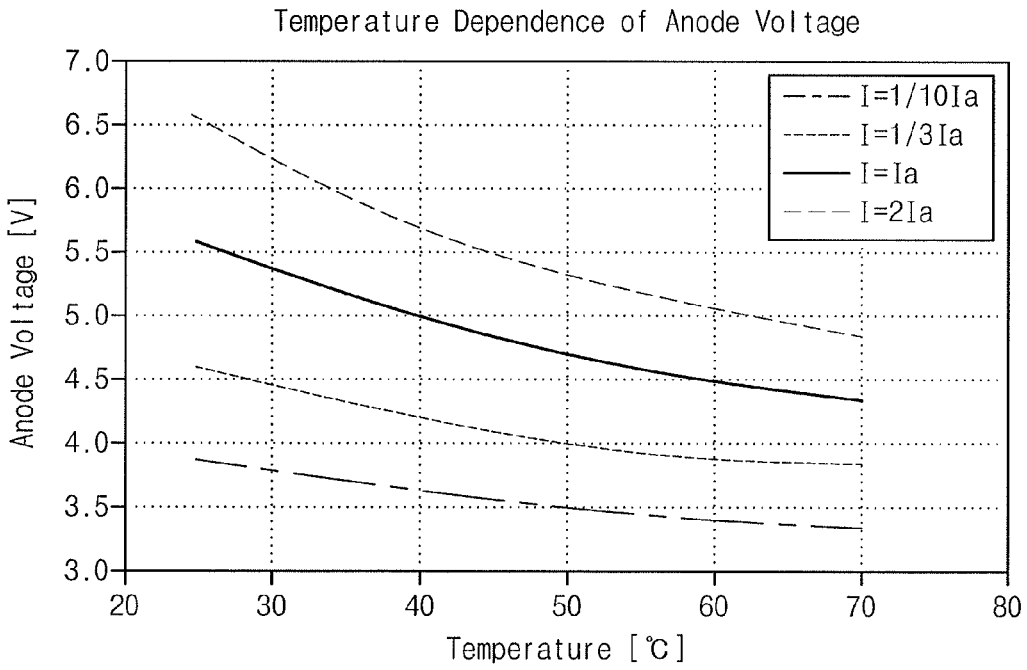
FIG. 13 illustrates an example of temperature dependence of an anode voltage for a light emitting device.

FIG. 13 illustrates an example of temperature dependence of an anode voltage of a light emitting device. Referring to FIG. 13, the anode voltage is lowered according to an increase in temperature. Here, the reference temperature is set as 25° C. The anode voltage represented in FIG. 13 may be expressed by Equation 1 or Equation 2.

$$\text{Voled}=C1\cdot\text{Temp}^{b1} \quad (1)$$

$$\text{Voled}=\text{C2}\cdot\ln(\text{Temp})+b2 \quad (2)$$

where C1, C2, b1, and b2 are integers and changed by a driving current, a light emitting device material, and a configuration of the display device, and the like. In one embodiment, C1 and C2, or, b1 and b2 may have the same value.

When the check current I for measuring the anode voltage Voled is the current Ia, the integer values C1, C2, b1, b2 are determined according to the driving current, the light emitting device material, and the configuration of the display device.

Because Equations 1 and 2 may be used as functions having temperature dependence, other functions may be used according to the light emitting device material and/or the configuration of the display device. For example, as a result that fitting was performed using functions of Equations 1 and 2 with respect to actually measured value of I=Ia in FIG. 13, integers in Equation 1 may be as follows: C1=12.049 and b1=−0.241. Examples of integers in Equation 2 may be as follows: C2=−1.185 and b2=−0.178.

When Equations 1 and 2 are modified, temperature may be expressed by Equations 3 and 4 as functions of the anode voltage Voled.

$$\text{Temp}=(\text{Voled}/C3)^{1/b3} \quad (3)$$

$$\text{Temp}=\exp^{((Voled-b4)/C4)} \quad (4)$$

where C3, C4, b3, and b4 are integers. In one embodiment, C3 and C4 have the same value and/or b3 and b4 may have the same value.

From Equations 3 and 4, a temperature of the light emitting device may be calculated from a difference between the measured anode voltage Voled and the already known reference anode voltage $V_{RT}$ at room temperature (e.g., 25° C.). The value of the already known reference anode voltage $V_{RT}$ may be a theoretical value. For example, the reference anode value may be a value measured in an environment controlled at a predetermined temperature (e.g., 25° C.) before shipment from a factory.

Figure 14:
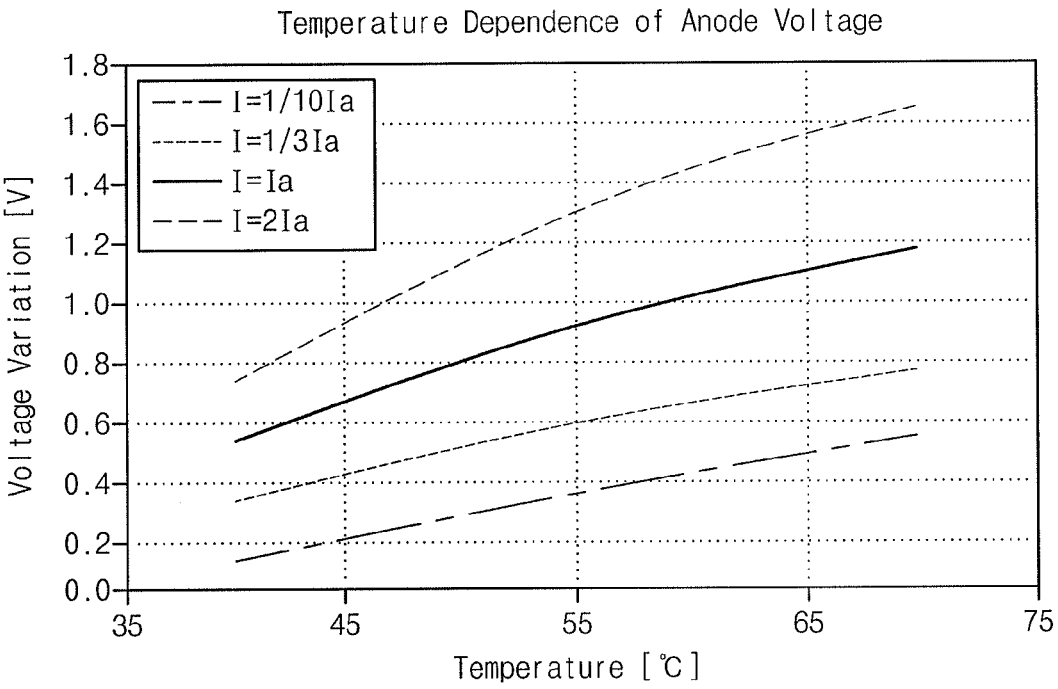
FIG. 14 illustrates an example of temperature dependence of an anode voltage variation for a light emitting device.

FIG. 14 illustrates temperature dependence of an anode voltage variation of a light emitting device according to one embodiment. More specifically, FIG. 14 represents temperature dependence of the anode voltage when a certain current I is applied to the light limiting device D1. Accordingly, FIG. 14 illustrates a voltage variation $\Delta V_T$ which is a difference value between the anode voltage Voled measured at each temperature and the reference anode voltage $V_{RT}$.

The voltage variation $\Delta V_T$ corresponds to a temperature compensation value for temperature-compensating the measured anode voltage Voled. A characteristic of the temperature compensation value may be expressed by Equation 5.

$$\Delta V_T=C5\cdot\ln(\text{Temp})+b5 \quad (5)$$

where C5 and b5 are integers.

The temperature compensation value $\Delta V_T$ may be calculated by substituting the temperature of the light emitting device, which may be calculated by Equations 3 or 4, into Equation 5. Furthermore, the temperature compensation value $\Delta V_T$ may be a value corresponding to the first, second, and third variation amounts $\Delta V_{T1}$, $\Delta V_{T2}$, $\Delta V_{T3}$ in FIGS. 11 and 12.

From the temperature compensation value $\Delta V_T$ calculated in Equation 5, the reference anode voltage $V_{RT}$ based on the room temperature RT (e.g., 25° C.) may be expressed by Equation 6.

$$V_{RT}=\text{Voled}(t)+\Delta V_T \quad (6)$$

Accordingly, an effect of the temperature variation for the light emitting device D1 may be compensated based on Equations 1 to 6. In one embodiment of an image sticking compensation method described below, an anode voltage value used for calculating the voltage variation ΔV is set as the reference anode voltage $V_{RT}$.

Figure 15:
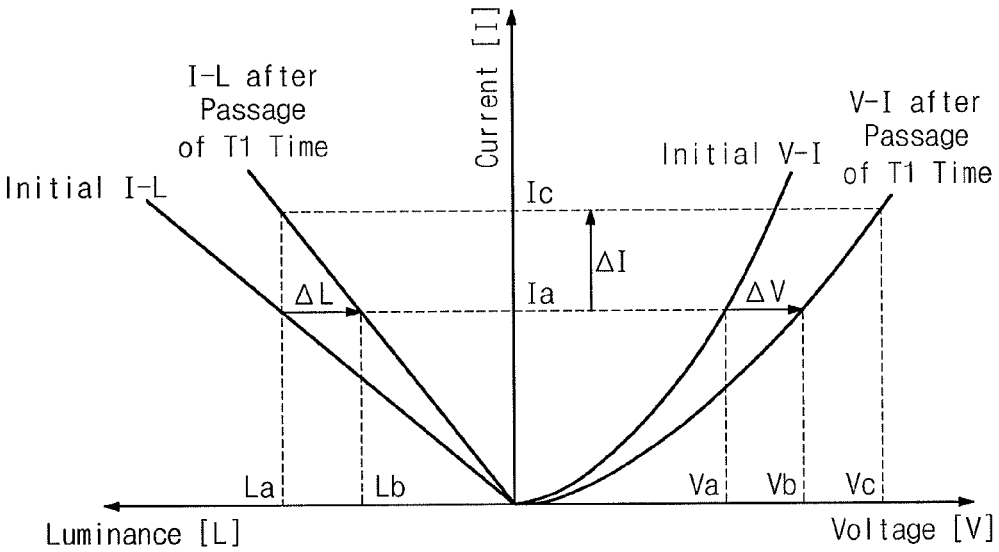
FIG. 15 illustrates a change in voltage-current-luminance characteristic for one embodiment of a light emitting device according to time variation.

FIG. 15 illustrates a change in voltage-current-luminance characteristic of a light emitting device based on a time variation according to one embodiment. Referring to FIG. 15, the voltage-current characteristic (V-I) shifts to a high voltage side based on a predetermined current value Ia, after a first time t1 passes from an initial state. Accordingly, a voltage for obtaining the current Ia increases to a voltage Vb by the voltage variation ΔV from an initial voltage Va.

In addition, the current-luminance characteristic (I-L) shifts to a low luminance side after the first time t1 passes from an initial state. Accordingly, the luminance with respect to the current Ia decreases to luminance Lb by a luminance variation ΔL from an initial luminance La. Thus, as time passes, the voltage variation ΔV and luminance degradation amount ΔL increase.

After the first time t1 passes, because a current value Ic is necessary for obtaining the same luminance as the initial luminance La, the necessary voltage value is Vc. In other words, a difference value between the initial current Ia and the current value Ic after passage of the first time t1 is a necessary current for the image sticking compensation.

Figure 16:
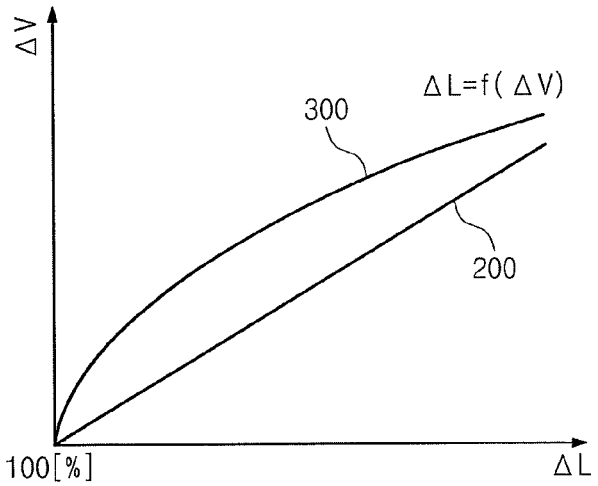
FIG. 16 illustrates an example of a relationship between voltage variation and luminance variation for one embodiment of a display device.

FIG. 16 illustrates a relationship between a voltage variation and a luminance variation of one embodiment of a display device. In FIG. 16, the luminance variation represents a luminance degradation rate when the initial luminance La is 100%. In other words, the luminance variation ΔL may be luminance degradation amount.

Referring to FIG. 16, the luminance degradation rate increases as the luminance degradation amount ΔL increases. In addition, the luminance amount ΔL increase in proportion to the voltage variation ΔV. A relationship between the voltage variation ΔV and the luminance amount ΔL may be expressed, for example, by Equation 7.

Even though the relationship between the voltage variation ΔV and luminance amount ΔL may be determined as a straight line 200 or a quadratic curve 300 according to materials used, in any case, the relationship may be expressed by Equation 7.

$$\Delta L=f(\Delta V) \quad (7)$$

In Equation 7, the function may be changed by each RGB light emitting device material or a device structure. However, the basic relationship does not change.

Figure 17:
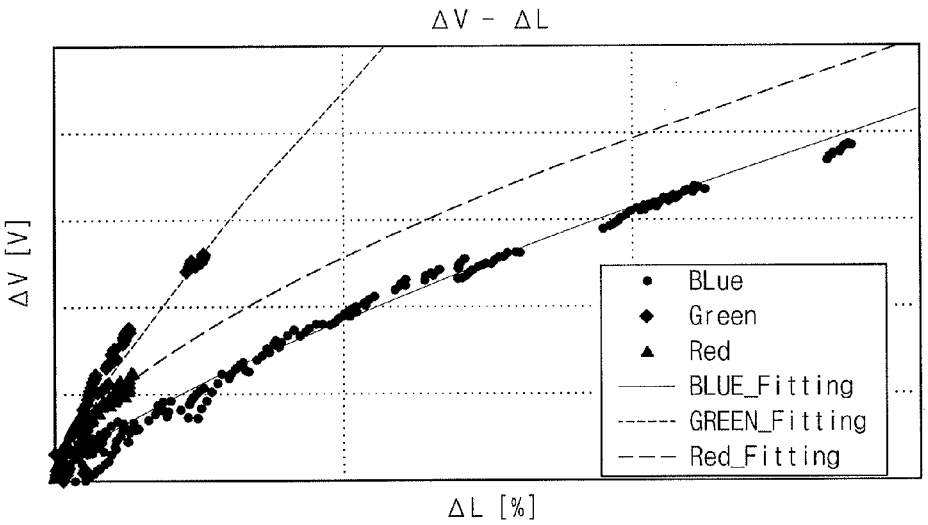
FIG. 17 illustrates actually measured data and fitting data of voltage variation and luminance variation of RGB pixels for one embodiment of a display device.

FIG. 17 illustrates an example of actually measured data and fitting data of voltage variation and luminance variation of RGB pixels of a display device. Referring FIG. 17, the curves therein represent actually measured values. Solid lines represent fitted ones using a function of Equation 8.

$$\Delta L=C8\cdot\Delta V^{b8}+A8 \quad (8)$$

where C8, b8, and A8 are integers. The luminance variation represents the luminance degradation rate when the initial luminance is 100%. The integer A8 is a predetermined value, e.g., 100.

Even though the characteristics may differ for each RGB device, as illustrated in FIG. 17, the actually measured value and the fitted value using the function of Equation 8 substantially match each other. For example, when the integer A8 is 100 and the measured values in FIG. 17 are fitted using the function of Equation 8, C and b may have the following values: C=−352 and b=2.288.

Figure 18:
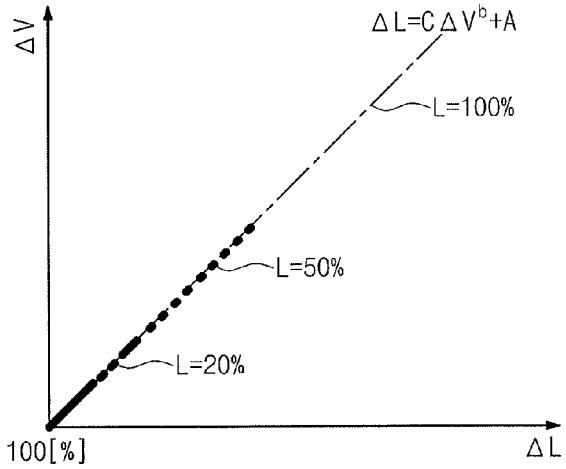
FIG. 18 illustrates gradation dependence of a relationship between a voltage variation and a luminance variation for one embodiment of a display device.

FIG. 18 illustrates gradation dependence of a relationship between voltage variation and luminance variation of one embodiment of a display device. More specifically, FIG. 18 illustrates characteristics of the voltage variation and luminance variation when the luminance of the light emitting device D1 is respectively set as L=100%, L=50%, and L=20%.

Referring to FIG. 18, even though luminance changes, the characteristics of the voltage variation ΔV and the luminance variation ΔL are plotted on the fitted function of Equation 8. Accordingly, the relationship of Equation 8 is valid even though the material or luminance of the light emitting device D1 is changed. Thus, even though different amounts of stress are accumulated on the pixels 100, the relationship of Equation 8 may be maintained in at least one embodiment.

As a result, luminance degradation may be calculated based on variation of the anode voltage of each pixel 100, from the relationship of Equation 8 between the voltage variation ΔV and luminance variation ΔL for light emitting devices D1 having different accumulated stress amounts.

Despite a data voltage change, because the relationship between the voltage variation ΔV and the luminance variation ΔL in FIG. 18 is maintained, the luminance degradation amount of the light emitting device D1 may be determined by measuring the variation ΔV in anode voltage of the light emitting device D1 using a predetermined driving current (a check current) Ia.

Because the luminance degradation amount may be calculated by measuring the anode voltage variation of the light emitting device D1, a compensation operation corresponding to the luminance degradation amount of each pixel 100 may be performed.

One embodiment of a method for calculating the compensation current may be explained with reference to FIG. 15.

An initial anode voltage Va is measured using the check current Ia. The measured anode voltage Va is stored in the memory 60 as a past anode voltage Va. An initial state where the initial anode voltage Va is measured is a state where check is performed before shipment from a factory. For example, the initial anode voltage Va may be measured under an environment controlled with a predetermined or measured room temperature RT, e.g., 25° C.

In addition, the initial anode voltage Va may be measured in all the pixels 100. By performing a check for the initial state, each integer of Equations 1 to 6 may be determined, and each integer of Equations 1 to 6 may be stored in the memory 60.

After the first time t1 passes, the anode voltage Vb is measured. The measured anode voltage Vb is stored in the memory 60 as a current anode voltage Vb. At the time of measurements of the past and current anode voltages Va and Vb, temperatures of the light emitting device are respectively calculated based on Equation 3 or 4.

The temperature compensation value ΔVT is calculated from the temperature calculated based on Equation 5, and past and current reference anode voltages $V_{RT}0$ and $V_{RT}1$ are obtained from the temperature compensation value ΔVT.

The voltage variation ΔV is calculated based on the current and past reference anode voltages $V_{RT}1$ and $V_{RT}0$. The luminance degradation amount ΔL is calculated from the calculated voltage variation ΔV based on Equation 8. Each integer C8, b8, or A8 in Equation 8 may be integer data based on a predicted degradation characteristic and may be stored in the memory 60 in advance.

The luminance degradation amount may be calculated using the foregoing method with respect to all the pixels 100 of the display device. In Equation 8, the compensation current ΔI is calculated from the luminance degradation amount ΔL calculated by Equation 8. In the current-luminance characteristic (I-L) in FIG. 15 after passage of the first time t1, a current value Ic may obtain the same luminance as the initial luminance La.

Difference between the driving current Ia and the current value Ic may be defined as the compensation current ΔI. Because the current-luminance characteristic (I-L) in FIG. 15 is a linear function, the compensation current ΔI may be expressed by Equation 9.

$$\Delta I=(Ia/\Delta L)-Ia \tag{9}$$

where, Ia is an initial driving current (check current).

In addition, the current value Ic for performing compensation from the compensation current ΔI calculated with Equation 9 may be expressed by equation 10.

$$Ic=Ia+\Delta I \tag{10}$$

Accordingly, the current value IC for compensation may be obtained.

Figure 19:
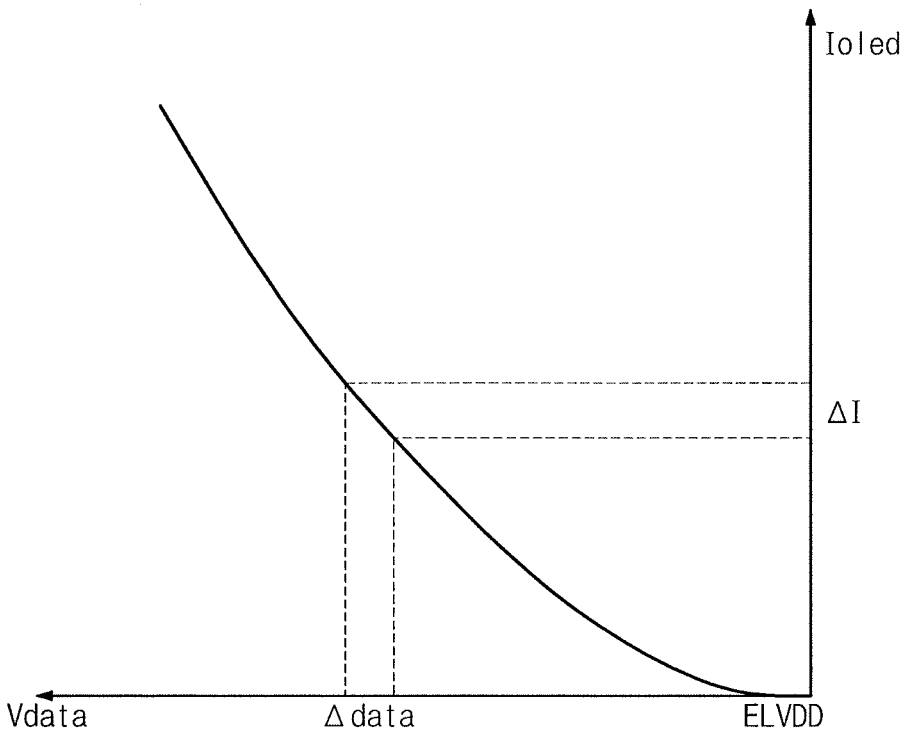
FIG. 19 illustrates a relationship between compensation current and compensation voltage for one embodiment of a display device.

FIG. 19 illustrates a relationship between compensation current and compensation voltage of one embodiment of a display device. Referring to FIG. 19, in order to compensate for luminance, compensation voltage data Δdata may be calculated from a gamma characteristic in FIG. 19, to allow the current Ioled flowing into the driving transistor M2 to have the current value Ic.

As described above, one embodiment of the compensation method performs compensation according to a degradation amount of each pixel 100, by performing temperature compensation for the measured anode voltage of the light emitting device and by expressing using a predetermined function the relationship between a change amount in temperature-compensated reference anode voltage and the luminance degradation amount.

As a result, a display device, a method for calculating compensation for the display device, and a method for driving method of the display device may be provided which reduces the image sticking phenomenon and improves display quality and reliability.

Figure 20:
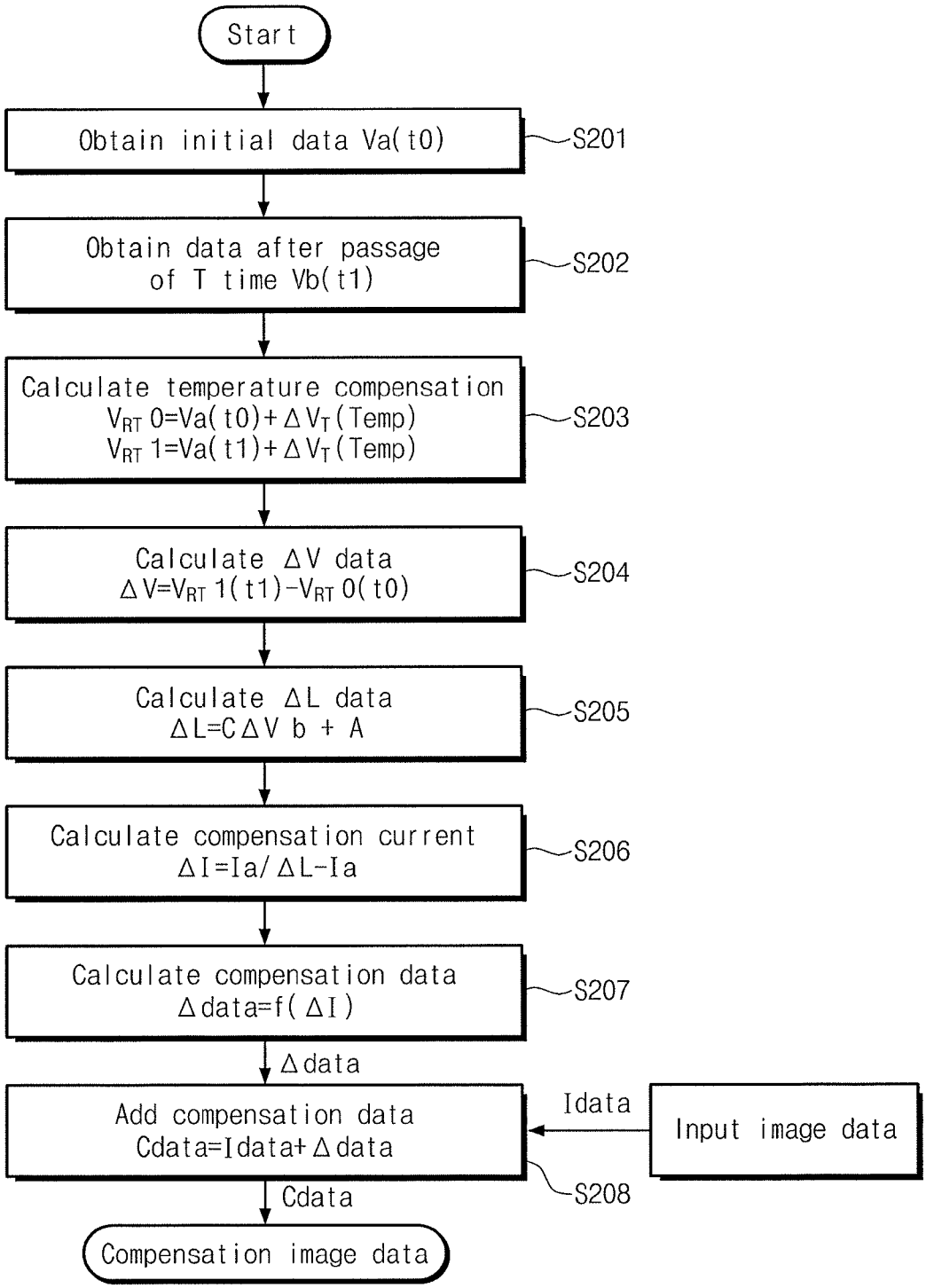
FIG. 20 illustrates an embodiment of a method for performing compensation in a display device.

FIG. 20 illustrates an embodiment of a method for performing compensation in a display device according. Referring to FIG. 20, the anode voltage Va(t0) at the initial state is measured with the check current Ia and the measured anode voltage Va(t0) is stored in the memory 60 (operation S201). After passage of the first time t1, the anode voltage Vb(t1) is measured, and the measured anode voltage Vb(t1) is stored in the memory 60 (operation S202).

For each of the anode voltages Va(t0) and Vb(t1), a temperature Temp of the light emitting device at the time of the measurement is measured based on Equations 3 and 4, a temperature compensation value $\Delta v_T$(Temp) is calculated from the calculated temperature Temp on the basis of Equation 5, and the past and the current reference anode voltages $V_{RT}0$ and $V_{RT}1$ are calculated based on Equation 6 (operation S203).

The anode voltage variation ΔV is calculated based on the calculated current and past reference anode voltages $V_{RT}1$ and $V_{RT}0$ (operation S204). The luminance degradation amount ΔL is calculated from the calculated voltage variation ΔV based on Equation 8 (operation S205).

The compensation current ΔI is calculated from the calculated luminance degradation amount ΔL based on Equation 9 (operation S206). The compensation voltage data Δdata is calculated from the calculated compensation current ΔI on the basis of the gamma characteristic illustrated in FIG. 19 (operation S207).

The compensation voltage data Δdata is output from the operation unit 70 to the compensation unit 80. The compensation unit 80 compensates for input data Idata received from a source using the compensation voltage data Δdata and outputs the compensated input data Idata as the compensated image data Cdata (operation S208).

Accordingly, the image sticking phenomenon in the display device may be reduced and display quality and reliability may be improved.

Figure 21:
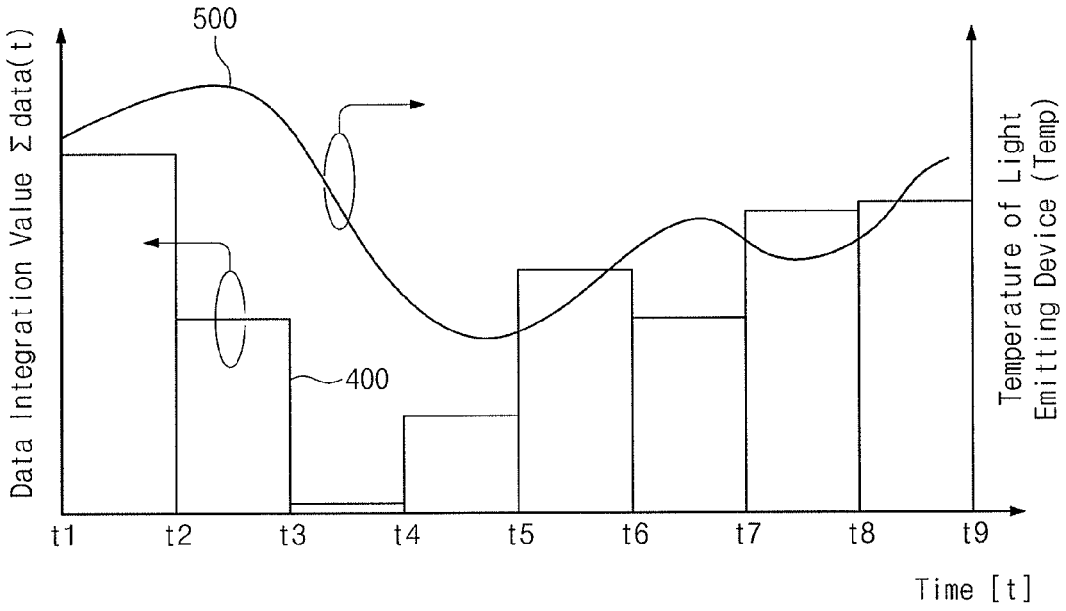
FIG. 21 illustrates a relationship between a data integration value and pixel temperature for one embodiment of a display device.
Figure 22:
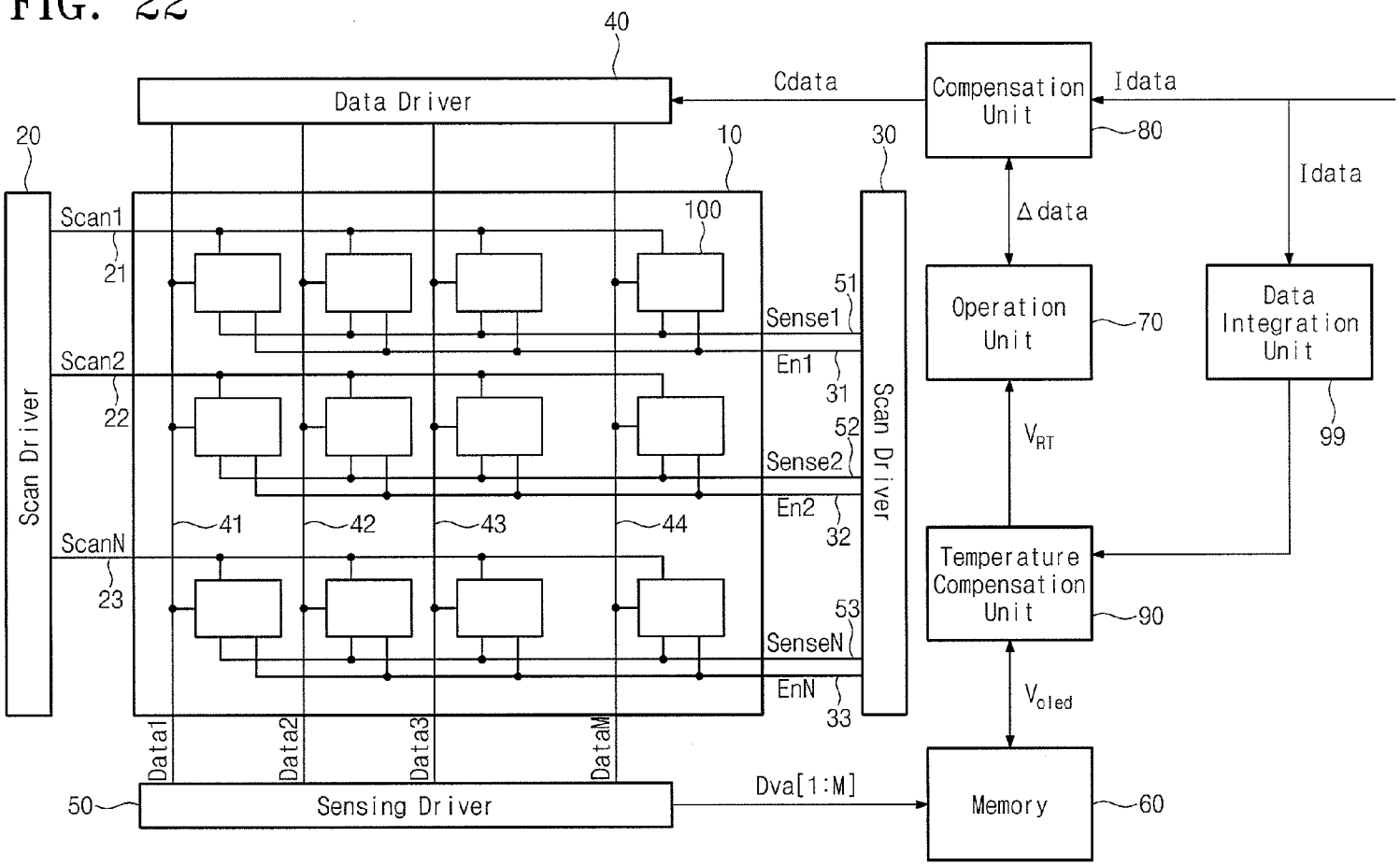
FIG. 22 illustrates another embodiment of a display device.
Figure 23:
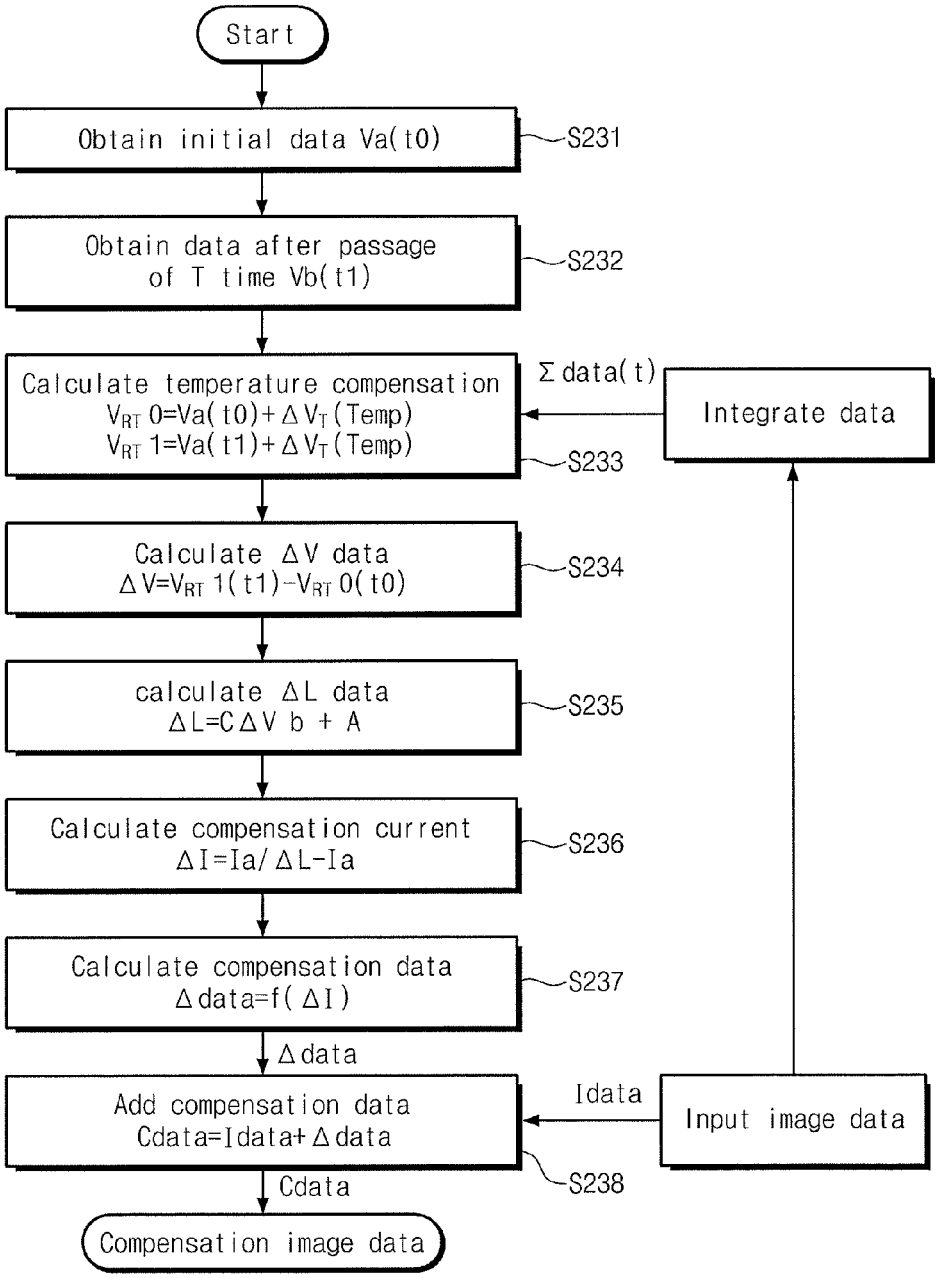
FIG. 23 illustrates another embodiment of a method for performing compensation in a display device.

FIGS. 21 to 23 described another embodiment of a display device. The display device of this embodiment may have substantially the same configuration and may use substantially the same compensation algorithm as the display device according to the aforementioned embodiments, except for a temperature compensation method. Accordingly, a temperature compensation method different from that of the display device according to one embodiment will be described below.

FIG. 21 illustrates a relationship between a data integration value and a pixel temperature of one embodiment of a display device. In FIG. 21, the horizontal axis denotes time, a left vertical axis denotes a data integration value 400 of a pixel in predetermined periods t1 to t2 and t2 to t3, . . . , and the right vertical axis denotes a pixel temperature 500.

Referring to FIG. 21, the data integration value 400 of the image input to the pixel is used to determine the temperature of the light emitting device D1. The data integration value may be a value where digital data is added to gradation data for each pixel of the display device. For example, the data value of a display device having 8-bit gradation may have any one of values 0 to 255, wherein 0 corresponds to black and 255 corresponds to white.

When white is continuously displayed, the data integration value may be 255+255+255+ . . . . When black is continuously displayed, the data integration value may be 0+0+0+ . . . . When white data is input to the pixel 100, a current value flowing into the light emitting device D1 becomes a maximum value and heat of the driving transistor becomes large. When white data is input to the pixel 100, current does not nearly flow into the light emitting device D1 and the heat of the driving transistor becomes very small.

Accordingly, for a predetermined period, temperature of the pixel increases as the data integration value increases. The relationship between the data integration value Σdata(t) and the pixel temperature may be expressed by Equation 11.

$$\text{Temp}=C11\cdot\Sigma\text{data}(t) \tag{11}$$

where C11 denotes an integer and is changed according to a pixel configuration and a configuration of the display device.

The integer C11 may be determined, for example, by measuring temperature dependence data of the anode voltage in the display device. In addition, the data integration value Σdata(t) corresponds to data values input to the pixels which are integrated for predetermined periods, for example, t1 to t2, and t2 to t3, . . . , as illustrated in FIG. 21. The temperature Temp of the light emitting device of the pixel may be predicted, for example, using Equation 11, instead of Equations 3 and 4. In addition, temperature compensation may be performed, for example, using Equations 5 and 6.

FIG. 22 illustrates another embodiment of a display device. Referring FIG. 22, the input data Idata is provided to the compensation unit 80 and the data integration unit 99. The data integration unit 99 integrates data for a predetermined period, and the data integration value Σdata(t) is provided to the temperature compensation unit 90.

FIG. 23 illustrates a flowchart for explaining another embodiment of a method for performing compensation in a display device. Referring to FIG. 23, the anode voltage Va(t0) at the initial state is measured with the check current Ia and the measured anode voltage Va(t0) is stored in the memory 60 (operation S231). After passage of the first time t1, the anode voltage Vb(t1) is measured, and the measured anode voltage Vb(t1) is stored in the memory 60 (operation S232).

For each of the anode voltages Va(t0) and Vb(t1), a temperature Temp of the light emitting device at the time of the measurement is calculated based on Equations 11, a temperature compensation value $\Delta v_T$(Temp) is calculated from the calculated temperature Temp on the basis of Equation 5, and the past and the current reference anode voltages $V_{RT}0$ and $V_{RT}1$ are calculated based on Equation 6 (operation S233).

The anode voltage variation ΔV is calculated based on a difference between the calculated current and past reference anode voltages $V_{RT}1$ and $V_{RT}0$ (operation S234). The luminance degradation amount ΔL is calculated from the calculated voltage variation ΔV based on Equation 8 (operation S235).

The compensation current ΔI is calculated based on the calculated luminance degradation amount ΔL using Equation 9 (operation S236). The compensation voltage data Δdata is calculated from the calculated compensation current ΔI based on the gamma characteristic illustrated in FIG. 19 (operation S237).

The compensation voltage data Δdata is output from the operation unit 70 to the compensation unit 80. The compensation unit 80 compensates for input data Σdata received from a source using the compensation voltage data Δdata and outputs the compensated input data Σdata as the compensated image data Cdata (operation S238).

Accordingly, an image sticking phenomenon of the display device may be reduced, and display quality and reliability may be improved.

By way of summation and review, each of the light emitting devices of a display may experience stress. The amount of degradation of the light emitting devices may differ based on differences in the amount of stress accumulated for each pixel. The amount of stress is proportional to the product of luminance (e.g., amount of current flowing into the light emitting device) and time. The luminance and amount of stress accumulated for each pixel may also differ for different display patterns.

Based on these and other influences, the amount of degradation experienced by each pixel may be non-uniform. Also, after a predetermined time passes, an image sticking phenomenon may occur, even though the same data voltage is applied to each pixel. As a result, the quality or reliability of the display may be degraded.

Several techniques have been proposed in an attempt to reduce the image sticking phenomenon. One technique performs compensation using data integration. According to this technique, output sub-pixel data for compensation is obtained according to accumulated addition values of input sub-pixel data. A gradation greater than a typical gradation is applied to pixels having great accumulated addition values, namely, pixels expected to have great pixel degradation.

However, the compensation values calculated based on data integration values may be different from actual degradation amounts of pixels. As a result, a compensation shortage or overcompensation phenomenon may occur and display quality may be degraded. Furthermore, when calculating the accumulated addition values, it is required to add by weighting each pixel in consideration of the stress amount based on input gradation data bits, not by simple integration. Accordingly, calculations become complex.

Another technique performs compensation using luminance measurement results for dummy pixels located outside of a display area. However, because the stress amounts are changed according to gradation data applied to the dummy pixels, it is difficult to completely match degradation amounts of the dummy pixels and actual pixels. In addition, even when the same stress amount is applied, when the degradation amount for each pixel changes, a change in pixel degradation may not be completely compensated only with degradation amounts of the dummy pixels.

In accordance with one or more of the aforementioned embodiments, the amount by which a temperature-compensated reference anode voltage changes is calculated for each pixel of a display device. The input data Σdata is compensated based on the calculated voltage variation ΔV, and then a compensation operation is performed based on a degradation amount of a light emitting device in each pixel. Accordingly, an image sticking phenomenon may be reduced and display quality and reliability may be improved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a pixel;

a sensing driver to measure a first voltage value applied to a light emitter in the pixel;

a memory to store a second voltage value previously measured for the pixel;

a first compensator to calculate a temperature of the light emitter at a time of measuring the first voltage value, and to compensate for the first voltage value based on the temperature; and a second compensator to compensate for input data for the pixel based on a voltage variation obtained from the temperature-compensated first voltage value and the second voltage value.

2. The device as claimed in claim 1, wherein the first compensator is to:

calculate the temperature based on one of the following equations, $$\text{Temp}=(\text{Voled}/C1)^{1/b1},$$

or $$\text{Temp}=\exp^{((Voled-b1)/C1)}$$

where Temp is the temperature, Voled is the first voltage value and C1 and b1 are predetermined integers, and compensate for the first voltage value based on the following equation:

$$\Delta V_T=C2\cdot\ln(\text{Temp})+b2$$

where ΔV is a temperature compensation value, Temp is temperature, and C2 and b2 are predetermined integers.

3. The device as claimed in claim 2, wherein the second voltage value is a value temperature-compensated by the first compensator.

4. The device as claimed in claim 3, further comprising:

operation logic to calculate the voltage variation from the first and second voltage values, to calculate an amount of luminance degradation from the voltage variation based on a first function, and to calculate a compensation current and compensation voltage data from the luminance degradation amount based on a second function, wherein the second compensator is to compensate for the input data based on the compensation voltage data.

5. The device as claimed in claim 4, wherein the first function includes the following equation:

$$\Delta L=C5\cdot\Delta V^{b5}+A5$$

wherein ΔL is the luminance degradation amount, ΔV is the voltage variation, and C5, b5, and A5 are predetermined integers.

6. The device as claimed in claim 4, wherein the second function includes the following equation:

$$\Delta I=(Ia/\Delta L)-Ia$$

where ΔI is the compensation current, ΔL is the luminance degradation amount, and Ia is a check current for measuring the voltage.

7. The device as claimed in claim 1, wherein the first compensator is to:

calculate the temperature based on the following equation:

$$\text{Temp}=C3\cdot\Sigma\text{data}(t)$$

where Temp is the temperature, t is a predetermined period, and where C3 is a predetermined integer, and compensate for the first voltage value based on the following equation:

$$\Delta V_T=C4\cdot\ln(\text{Temp})+b4$$

where $\Delta V_T$ is the temperature compensation value to compensate for the first voltage value, Temp is the temperature, and where C4 and b4 are predetermined integers.

8. A method of calculating compensation data of a display device, the method comprising:

measuring a first voltage value applied to a light emitter in a pixel;

calculating a temperature of the light emitter at a time of measuring the first voltage value;

compensating for the first voltage value based on the temperature;

calculating a voltage variation based on the temperature-compensated first voltage value and a second voltage value previously measured and stored in a memory for each of the pixels; and compensating for input data for the pixel based on the voltage variation.

9. The method as claimed in claim 8, wherein calculating the temperature is performed based on one of the following equations:

$$\text{Temp}=(\text{Voled}/C1)^{1/b1},$$

or $$\text{Temp}=\exp^{((Voled-b1)/C1)}$$

where Temp is the temperature, Voled is the first voltage value, and C1 and b1 are predetermined integers, and wherein compensating for the first voltage value is performed based on the following equation:

$$\Delta V_T=C2\cdot\ln(\text{Temp})+b2$$

where Temp is the temperature, $\Delta V_T$ is a temperature compensation value, and C2 and b2 are predetermined integers.

10. The method of claim 9, wherein the second voltage value is a value compensated based on the light emitter at a time of measuring the second voltage value.

11. The method as claimed in claim 10, wherein compensating for the input data includes:

calculating an amount of luminance degradation from the voltage variation based on the first function;

calculating a compensation current from the luminance degradation amount based on the second function;

adjusting compensation voltage data based on the compensation current; and compensating for the input data based on the compensation voltage data.

12. The method as claimed in claim 11, wherein the first function includes the following equation:

$$\Delta L=C5\cdot\Delta V^{b5}+A5$$

where ΔL is the luminance degradation amount, ΔV is the voltage variation, and C5, b5, and A5 are predetermined integers.

13. The method as claimed in claim 11, wherein the second function includes the following equation:

$$\Delta I=(Ia/\Delta L)-Ia$$

where ΔI is the compensation current, ΔL is the luminance degradation amount, and Ia is a check current for measuring the voltage.

14. The method as claimed in claim 8, wherein calculating the temperature is performed based on the following equation:

$$\text{Temp}=C3\cdot\Sigma\text{data}(t)$$

where Temp is the temperature, t is a predetermined period, and C3 is a predetermined integer, and wherein compensating for the first voltage value is performed based on the following equation:

$$\Delta V_T=C4\cdot\ln(\text{Temp})+b4$$

where Temp is the temperature, $\Delta V_T$ is the temperature compensation value to compensate for the first voltage value, and C4 and b4 are predetermined integers.

15. A driving method of a display device, comprising:

measuring a first voltage value applied to a light emitter in a pixel;

calculating a temperature of the light emitter at a time of measuring the first voltage value;

compensating for the first voltage value based on the temperature;

calculating a voltage variation based on the temperature-compensated first voltage value and a second voltage value previously measured and stored in a memory; and compensating for input data for the pixel based on the voltage variation.

16. The method as claimed in claim 15, wherein calculating the temperature is performed based on one of the following equations:

$$\text{Temp}=(\text{Voled}/\text{C1})^{1/b1},$$

or $$\text{Temp}=\exp^{((Voled-b1)/C1)}$$

where Temp is the temperature, Voled is the first voltage value, and C1 and b1 are predetermined integers, and wherein compensating for the first voltage value is performed based on the following equation:

$$\Delta V_T=C2\cdot\ln(\text{Temp})+b2$$

where Temp is the temperature, $\Delta V_T$ is a temperature compensation value, and C2 and b2 are predetermined integers.

17. The method as claimed in claim 16, wherein the second voltage value is a value compensated based on the temperature of the light emitter at a time of measuring the second voltage value.

18. The method of claim 15, wherein compensating for the input data includes:

calculating an amount of luminance degradation from the voltage variation based on the first function;

calculating a compensation current from the luminance degradation amount based on the second function;

adjusting compensation voltage data to the compensation current; and compensating for the input data based on the compensation voltage data.

19. The method as claimed in claim 18, wherein the first function includes the following equation:

$$\Delta L=C5\cdot\Delta V^{b5}+A5$$

where ΔL is the luminance degradation amount, ΔV is the voltage variation, and C5, b5, and A5 are predetermined integers, and wherein the second function includes the following equation:

$$\Delta I=(Ia/\Delta L)-Ia$$

where ΔI is the compensation current, ΔL is the luminance degradation amount, and Ia is a check current for measuring the voltage.

20. The method as claimed in claim 15, wherein calculating the temperature is performed based on the following equation:

$$\text{Temp}=C3\cdot\Sigma\text{data}(t)$$

where Temp is the temperature, t is a predetermined period t, and C3 is predetermined integer, and wherein compensating for the first voltage value is performed based on the following equation:

$$\Delta V_T=C4\cdot\ln(\text{Temp})+b4$$

where Temp is the temperature, $\Delta V_T$ is the temperature compensation value $\Delta V_T$ to compensate for the first voltage value, and C4 and b4 are predetermined integers.

* * * * *